US005674162A

United States Patent [19]

Ellingson et al.

[11] Patent Number: 5,674,162

[45] Date of Patent: Oct. 7, 1997

[54] BIOMECHANICAL STABILIZER APPARATUS AND METHODS FOR STRENGTHENING UNSTABLE JOINTS AND IMPROVING MUSCLE COORDINATION

[76] Inventors: Richard L. Ellingson; E. Paul France; Roger Petersen, all of 6158 S. 350 West #5, Salt Lake City, Utah 84157; Leonard C. Smith, 766 Quaking Aspen Dr., Murray, Utah 84123; David W. Bernardi, 1725 Creek Side La., Park City, Utah 84060

[21] Appl. No.: 487,487

[22] Filed: Jun. 7, 1995

[51] Int. Cl.[6] ..... A63B 21/22

[52] U.S. Cl. ..... 482/110; 482/44

[58] Field of Search ..... 446/170; 482/1, 482/3, 8, 44–46, 49, 110, 50, 93, 98, 104, 106, 108–109

[56] References Cited

U.S. PATENT DOCUMENTS

| | | | |
|---|---|---|---|
| 1,333,005 | 3/1920 | Warner | 272/84 |
| 2,466,116 | 4/1949 | Marong | 46/51 |
| 2,662,336 | 12/1953 | Zalkind | 446/170 |
| 3,006,646 | 10/1961 | Nanni | 482/109 X |
| 3,482,835 | 12/1969 | Dean | 272/84 |
| 3,901,503 | 8/1975 | Klose | 272/57 |
| 4,029,312 | 6/1977 | Wright | 272/123 |
| 4,278,248 | 7/1981 | Kifferstein | 482/93 X |
| 4,356,915 | 11/1982 | Phillips | 206/315 |
| 4,480,831 | 11/1984 | Muller-Deinhardt | 272/128 |
| 4,632,391 | 12/1986 | Orak | 272/128 |
| 4,674,987 | 6/1987 | Sober | 446/170 |
| 4,938,477 | 7/1990 | Kuervers | 482/105 |
| 4,943,047 | 7/1990 | Noble | 482/3 X |
| 4,982,954 | 1/1991 | Lazar | 272/93 |
| 5,147,262 | 9/1992 | Hymanson | 482/110 |
| 5,284,458 | 2/1994 | Perry et al. | 482/49 |
| 5,335,188 | 8/1994 | Brisson | 482/8 X |
| 5,364,325 | 11/1994 | Matthews | 482/93 X |

*Primary Examiner*—Richard J. Apley
*Assistant Examiner*—David R. Risley
*Attorney, Agent, or Firm*—Broadbent, Hulse, Pierce & Pate

[57] ABSTRACT

A biomechanical stabilizer apparatus and methods for strengthening unstable joints and improving muscle coordination is disclosed in one presently preferred embodiment of the present invention as comprising a tubing assembly incorporating a substantially circular member and an elongated handle member. In current design, the handle member extends substantially transverse dimensionally across the internal diameter of the circular member and is operably connected thereto. Preferably, the circular member is formed having an internal channel comprising two or more free moving bodies disposed therein. Similarly, the handle member is formed having an internal chamber wherein at least one free moving body is operably disposed. Preferably engaging the handle member is a timer unit for programming time durations and providing means for visual and/or audio feedback to the user when the programming parameters of the present invention are satisfied. In operation, the present invention provides orbital oscillatory exercise movements by initiating the orbital rotation of the free moving bodies disposed within the internal channel. Alternatively, the present invention facilitates linear oscillatory exercise by initiating the linear rotation of the free moving body disposed within the internal chamber of the handle member thereby providing strength to agonist-antagonist muscles or muscle groups.

25 Claims, 4 Drawing Sheets

BIOMECHANICAL STABILIZER APPARATUS AND METHODS FOR STRENGTHENING UNSTABLE JOINTS AND IMPROVING MUSCLE COORDINATION

BACKGROUND

1. The Field of the Invention

This invention relates to exercise devices and, more particularly, to a novel biomechanical stabilizer apparatus and methods for strengthening unstable joints and improving muscle coordination.

2. The Background Art

Physical therapy is a key element in the treatment of various musculoskeletal disabilities and diseases. The advantages of therapeutic exercise typically involve the development, improvement, restoration and/or maintenance of an individual's normal level of muscular strength, endurance, coordination, flexibility and/or mobility. Similarly, the general focus of rehabilitation programs is to return the individual to as normal and full a lifestyle as possible, or alternatively, to maintain or maximize the remaining biomechanical function(s) of affected body systems.

The development of muscle strength, coordination and flexibility typically enhances a muscle's ability to accommodate stress, dissipate impact shock and improve performance. Because muscle strength, coordination and flexibility are specific to the individual, the activity in which he or she is involved, and the joint or joints involved in the particular activity, a muscle which is capable of contracting strongly and effectively is generally well-equipped to absorb force and deformation, thus reducing a risk of injury.

Muscle coordination and flexibility are traditionally dependent upon two components: (1) a joint's range of motion, which can be generally defined as the motion available at any single joint based on the ability of the periarticular connective tissue to deform in correlation with the specific joint's arthrokinematics; and (2) muscle flexibility, or the ability of the muscle to elongate or lengthen, allowing a single joint or a series of joints to move through their full available range of motion. If the bony architecture and articular alignment of a joint are normal, the connective tissue structures that surround the joint typically become the principal factors which restrict or limit normal joint range of motion.

As generally defined, muscle flexibility is substantially equivalent to the range of motion available in a joint, such as the hip, or a series of joints, such as the shoulder or spine. The flexibility and mobility of the soft tissues which surround the joint, such as the muscles, connective tissue and skin, in combination with adequate joint articulation are usually necessary to accommodate normal joint range of motion. Similarly, muscle and periarticular connective tissue surrounding the joint should generally be able to deform in the time required for a specific activity to take place.

If not fully stretched or exercised, muscles progressively tighten and begin to weaken whereby limiting their active range of motion. Abnormally tight muscles can alter form and reduce biomechanical efficiency, thus creating a climate for injury such as, for example, joint instability, muscle strain, chronic muscle fatigue, tendinitis, etc. In this regard, general exercise programs for enhancing muscle flexibility and joint range of motion were developed to provide tissue and muscle which could elongate over a required distance and remain sufficiently strong and compliant to resist tensile forces applied thereto. Correspondingly, the development of muscle strength, coordination and flexibility typically requires both static and dynamic components to maintain versatility.

For the reasons discussed above, prior art weight machines and portable exercise devices were developed by those skilled in the art to facilitate both static and dynamic forms of exercise. For example, prior art barbell exercise devices were developed having disc-shaped weights firmly attached to a shaft running through a handle, whereby the handle is provided with bearings or a fly-wheel so that the shaft can turn freely and the weights can rotate in unison thereon.

Prior art barbell exercise devices typically provide an exercise-effect of loading or, in some instances, overloading an isolated muscle or muscle group with various degrees of heaviness as a result of the association between the physical load of the disc-shaped weights and the centrifugal force caused by the rotation of these weights. Although prior art barbell exercise devices generally afford meaningful advantages over stationary weight machines in relation to their function for facilitating isolated muscular weight training, the overall effectiveness of such prior art barbell devices has been questioned in view of their relationship in providing efficient therapeutic and/or rehabilitative exercising advantages.

To alleviate various disadvantages associated with prior art barbell exercise devices, those skilled in the art developed exercise devices comprising a hoop or housing member having a hollow, inner chamber wherein a single, weighted body can be disposed and placed into rotation within the inner chamber. The exercise benefits of these prior art exercise devices, however, are typically contingent on the amount of physical force which can be exerted by the user to maintain the "weighted" free moving body in rotation within the inner chamber of the housing member. Moreover, the concentrated mass and velocity of the single, weighted free moving body in combination with the relatively small radius of curvature of the inner chamber generally creates a substantially high angular momentum and a significant centrifugal force against which the user must readily act in order to shift the plane of rotation of the device when the weighted body is in motion. A significant disadvantage of these prior art exercise devices is the inability to easily shift the plane of the device when the weighted body is in motion, thereby restricting their overall therapeutic and rehabilitative effectiveness and application, especially with a user having limited muscular ability.

Although the prior art contemplates exercise devices including a counter device which is capable of counting and displaying the number of revolutions of a moving body within the housing member and a sensor device for determining and displaying the speed of the moving body, none of these prior art exercise devices teach, disclose or suggest a device having a visual and/or audio biofeedback means for monitoring the lapse of a programmed time during a therapeutic and/or rehabilitative exercise program. Typically, the users of prior art therapeutic and/or rehabilitative exercise devices are constrained to visit a physical therapy facility or a doctor's office for close supervision when conducting therapeutic and/or rehabilitative exercises to strengthen an injured muscle(s) or unstable joint(s) and/or improve disoriented muscle coordination.

As illustrated by the number of prior patents and disclosures, efforts are continuously being made in an attempt to develop exercise devices which will accommodate the foregoing therapeutic and rehabilitative disadvantages. In this regard, the present invention provides for a novel biomechanical stabilizer apparatus that overcomes several deficiencies of prior art exercise devices and resolves several problems left unsolved by known prior art devices.

BRIEF SUMMARY AND OBJECTS OF THE INVENTION

In view of the foregoing, it is a primary object of the present invention to provide a novel biomechanical stabilizer apparatus and methods which facilitate therapeutic and/or rehabilitative exercise for strengthening unstable joints and improving muscle coordination that can be conducted at home, whereby reducing the number of expensive therapy visits to a doctor's office or physical therapy facility.

It is also an object of the present invention to provide a biomechanical stabilizer apparatus for strengthening unstable joints and improving muscle coordination which is capable of facilitating both orbital and linear oscillatory movements to provide means for increasing the therapeutic and/or rehabilitative efficiency of a user's exercise output by inducing increased muscular contraction and relaxation.

Further, it is an object of the present invention to provide a biomechanical stabilizer apparatus for strengthening unstable joints and improving muscle coordination which comprises a plurality of free moving bodies operably disposed within a tubing assembly and which are therapeutically important, in combination, to help establish an oscillatory frequency needed to initiate and maintain these bodies in an orbital or linear rotational motion.

It is a still further object of the present invention to provide a biomechanical stabilizer apparatus and methods for strengthening unstable joints and improving muscle coordination which provides an integral, interactive timer unit for programming and monitoring the durational lapse of time and for providing means of visual and/or audio feedback to the user when conducting therapeutic and/or rehabilitative exercise.

In addition, it is an object of the present invention to provide a biomechanical stabilizer apparatus and methods for strengthening unstable joints and improving muscle coordination which is inherently entertaining to use and capable of providing different levels of exercise resistance.

Consistent with the foregoing objects, and in accordance with the invention as embodied and broadly described herein, a biomechanical stabilizer apparatus for strengthening unstable joints and improving muscle coordination is disclosed in one preferred embodiment of the present invention as comprising a tubing assembly incorporating a substantially circular member and an elongated handle member. The handle member preferably extends substantially transverse dimensionally across the internal diameter of the circular member and is operably connected thereto. Preferably, the circular member is formed having an internal channel comprising at least one free moving body rotatably disposed therein. Similarly, the handle member is formed having an internal chamber wherein at least one free moving body can be disposed. Engaging the handle member is a timer unit for programming time durations and providing means for visual and/or audio feedback to the user when the programming parameters of the present invention are satisfied.

In operation, a user of the present invention begins by gently rocking the circular member in an orbital motion in order to initiate the rotation of the free moving bodies disposed within the internal channel. As the free moving bodies begin to oscillate back and forth, the user, by preferably gripping the handle member, begins to generate orbital oscillation movements of the free moving bodies within the internal channel. Correspondingly, it is important to coordinate the orbital hand movements of the circular member with the motion and direction of the free moving bodies. Alternatively, the present invention provides means for facilitating linear exercise by oscillating the free moving body disposed within the internal chamber of the handle member through multiple ranges in a cardinal plane which provides strength to agonist-antagonist muscles or muscle groups.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
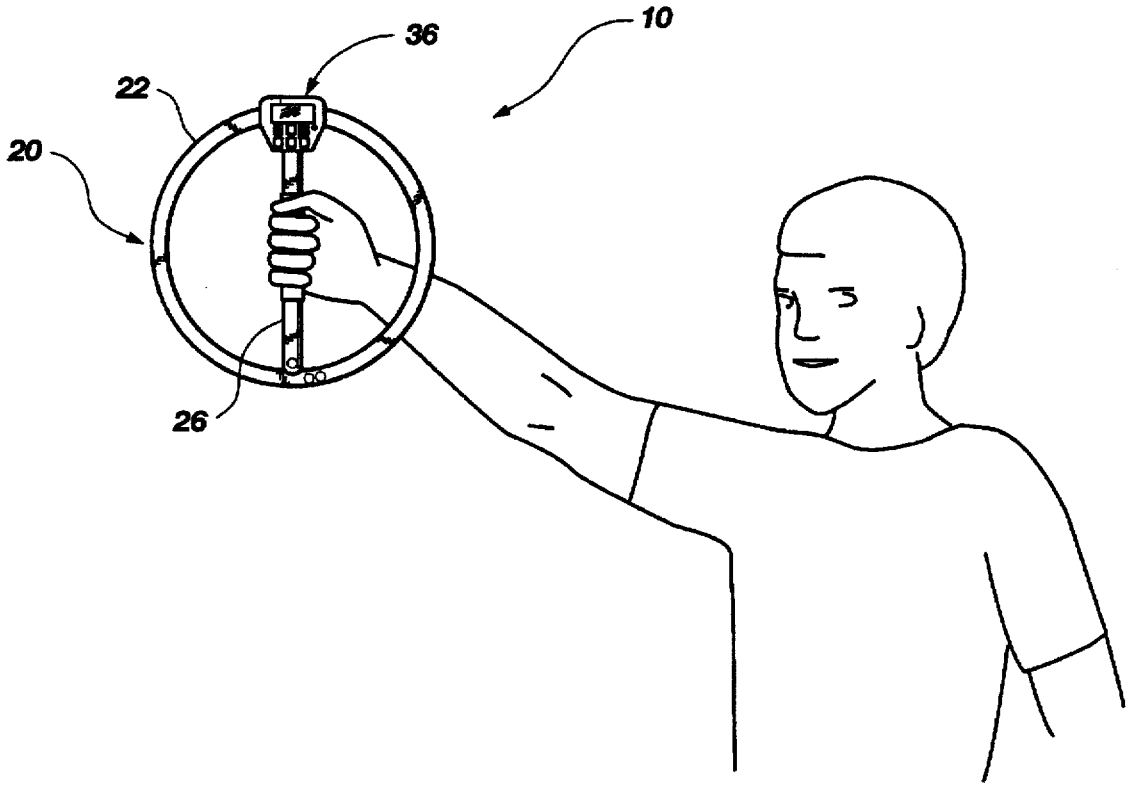
FIG. 1 is a perspective view of the biomechanical stabilizer apparatus for strengthening unstable joints and improving muscle coordination in accordance with one presently preferred embodiment of the present invention.
Figure 2:
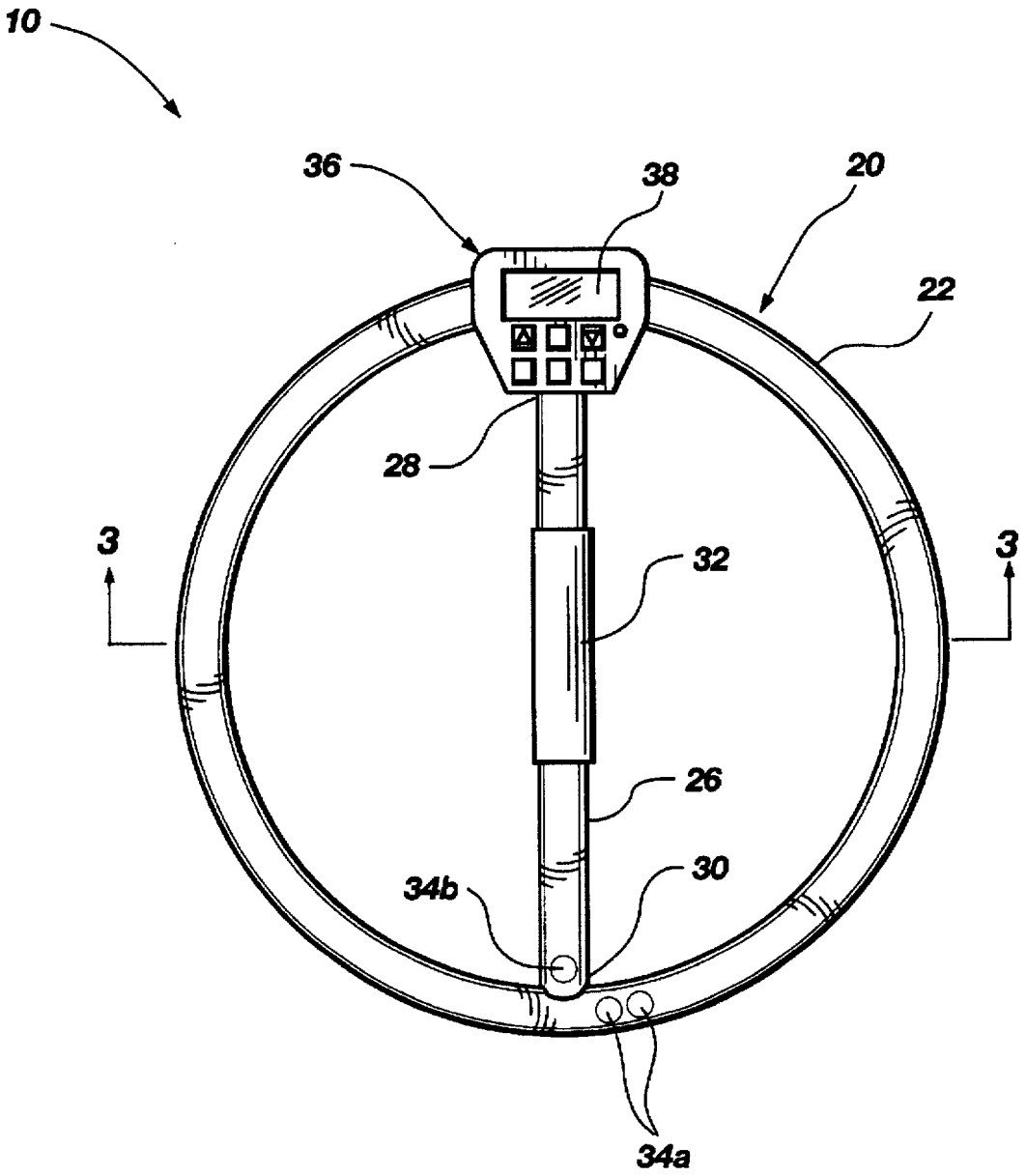
FIG. 2 is a front elevational view of the presently preferred embodiment of the biomechanical stabilizer apparatus for strengthening unstable joints and improving muscle coordination as illustrated in FIG. 1.

One presently preferred embodiment of the present invention, designated generally at 10, is best illustrated in FIGS. 1 and 2. As shown, biomechanical stabilizer apparatus 10 comprises a tubing assembly 20 incorporating a substantially circular member 22 and a handle member 26. Handle member 26 preferably extends substantially transverse dimensionally across the internal diameter of circular member 22 and is operably connected thereto at opposing ends 28, 30. Preferably, circular member 22 is formed having an internal channel 24 including at least one free moving body 34*a* rotatably disposed therein. Similarly, handle member 26 is formed having an internal chamber 31 wherein at least one free moving body 34*b* is disposed. Engaging handle member 26 is a programmable timer unit 36 for programming time durations and providing means for visual and/or audio feedback to the user when the programming parameters of the present invention are satisfied.

In current design, member 22 is substantially circular in configuration having an internal diameter of approximately twelve (12) inches and an annular cross-section providing a periphery sufficient to facilitate gripping. Preferably, circular member 22 is formed including an internal channel 24 having an annular cross-section being substantially equivalent to the annular cross-sectional periphery of circular member 22. It will be readily appreciated, however, that other shapes, configurations or sizes of member 22 are possible, such as, for example, oval, ellipsoidal, toroidal, ring-shaped, semi-circular, etc.

Circular member 22 is preferably formed of a sufficiently sturdy, semi-rigid polymeric material being generally transparent or slightly tinted to permit the user to visually observe the orbital oscillation of free moving bodies 34*a* within internal channel 24. In accordance with the preferred design of the present invention, circular member 22 may alternatively be formed of glass, fiberglass, ceramic, graphite, wood or any numerous organic, synthetic or processed materials which are mostly thermoplastic or thermosetting polymers of high molecular weight with or without additives, such as plasticizers, autooxidants, colorants, or fillers, that can be shaped, molded, cast, extruded, drawn, foamed or laminated into objects, films or filaments.

In one presently preferred embodiment of the present invention, circular member 22 is comprised of a polyurethane material. The inherent physical properties and characteristics of polyurethane tend to provide a "slick" interior surface of internal channel 24 whereby influencing a decrease in the coefficient of friction between the interior contacting surface of internal channel 24 and free moving bodies 34*a* rotatably disposed therein. In an alternate preferred embodiment, circular member 22 may be formed of a polyvinyl material having inherent physical properties and characteristics which provide a slightly "sticky" interior surface of internal channel 24 thereby influencing an increase in the coefficient of friction between the interior contacting surface of internal channel 24 and free moving bodies 34*a* rotatably disposed therein. Consistent with the foregoing materials, the particular physical properties and characteristics of circular member 22 are thus important for controlling the degree of therapeutic and/or rehabilitative orbital exercise delivered by biomechanical stabilizer apparatus 10.

Handle member 26 preferably extends substantially transverse dimensionally across the internal diameter of circular member 22. Being substantially elongated in configuration, handle member 26 is formed having a first end 28 and a second end 30 being operably connected at opposing ends along the internal periphery of circular member 22. First end 28 and second end 30 of handle member 26 are preferably formed having a complimentary contoured shape being generally semi-circular in configuration so as to extend over between approximately 15% and 50% of the outer periphery of the annular cross-section of circular member 22.

In current design, first end 28 and second end 30 of handle member 26 are rigidly secured to circular member 22 by means of an adhesive, such as, for example, epoxy resins, polyurethane resins, butyl tape, polysulfide elastomers, elastomeric styrene-butadiene copolymers, polycarbonate polymers, mucilaginous substances or the like. Alternatively, other conventional fasteners, securing means or compatible fastening components may be used which are consistent with the spirit and scope of the present invention.

In one presently preferred embodiment of the present invention, handle member 26 is formed having an annular cross-section providing an outer periphery sufficient to facilitate a gripping means 32, as best shown in FIG. 2. Gripping means 32 is preferably disposed along a medial portion of elongated handle member 26 and securely fastened thereto. In current design, gripping means 32 is formed of a soft, resilient material which conforms to the annular cross-sectional periphery of handle member 26. Thus, for example, gripping means 32 may be formed of polymeric foams, elastomeric rubbers, cloth, resilient plastics, etc. Moreover, gripping means 32 may be formed in a variety of shapes and configurations so as to facilitate a gripping means which is consistent with the spirit and scope of the present invention.

Figure 3:
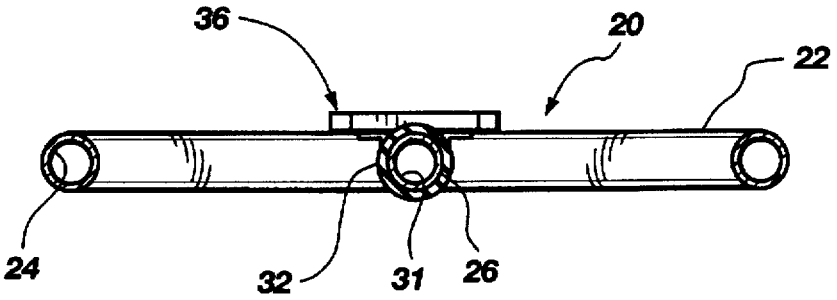
FIG. 3 is a cross-sectional view of the presently preferred embodiment of FIG. 2 taken along lines 3—3 of FIG. 2.

Integrally disposed within handle member 26 is an internal chamber 31 having an annular cross-sectional area being substantially equivalent to the annular cross-sectional periphery of handle member 26, as best illustrated in FIG. 3. It will be readily appreciated, however, that other shapes or configurations of handle member 26 are possible, such as, for example, a curvilinear member, a longitudinal member being slightly tapered at first end 28 and second end 30, a substantially elongated rectangular member, a substantially triangular member, an "H" shaped member, etc.

Handle member 26 is preferably formed of a sufficiently rigid polymeric material being generally transparent or slightly tinted to permit the user to visually observe the linear rotation of free moving body 34*b*. Thus, for example, handle member 26 may be formed of a thermoplastic material, such as, an acrylic resin or polycarbonate material, or any other suitable composite material which provides sufficient rigidness.

In one presently preferred embodiment of the present invention, handle member 26 is formed of a polyurethane material. Accordingly, the inherent physical properties and characteristics of polyurethane tend to provide a "slick" interior surface of internal chamber 31 whereby influencing a decrease in the coefficient of friction between the interior contacting surface of internal chamber 31 and free moving body 34*b*. Alternatively, handle member 26 may be formed of a polyvinyl material having inherent physical properties and characteristics which provide a slightly "sticky" interior surface of internal chamber 31 thereby influencing an increase in the coefficient of friction between the interior contacting surface of internal chamber 31 and free moving body 34*b* disposed therein. Correspondingly, the particular physical properties and characteristics of handle member 26 are thus important for controlling the degree of therapeutic and/or rehabilitative linear exercise delivered by biomechanical stabilizer apparatus 10.

Free moving bodies 34*a*, 34*b* may be formed of any configuration so long as their ability to rotate within internal channel 24 of circular member 22 and internal chamber 31 of handle member 26, respectively, are unobstructed. In the presently preferred current design, free moving bodies 34*a*, 34*b* are substantially spherical in shape having a diameter which is smaller than the annular cross-sectional area of internal channel 24 and internal chamber 31, respectively.

Preferably, free moving bodies 34a, 34b comprise stainless steel balls being configured with a substantially smooth outer surface, that, as used herein, means that the surface is substantially free from roughness and projections. Moreover, free moving bodies 34a, 34b are formed having a physical weight sufficient to overcome the coefficient of friction acting between free moving bodies 34a, 34b and the contacting surfaces of internal channel 24 and internal chamber 31, respectively. It will be readily appreciated, however, that free moving bodies 34a, 34b may be formed of other suitable components or materials, such as, for example, rubber, wood, plastic, fiberglass, metal, ceramic, glass, graphite or any other suitable composite materials.

In one presently preferred embodiment of the present invention, at least two free moving bodies 34a are housed within internal channel 24 of circular member 22 to facilitate orbital oscillation therein. Similarly, one free moving body 34b is housed within internal chamber 31 of handle member 26 to facilitate linear oscillation therein.

Figure 4:
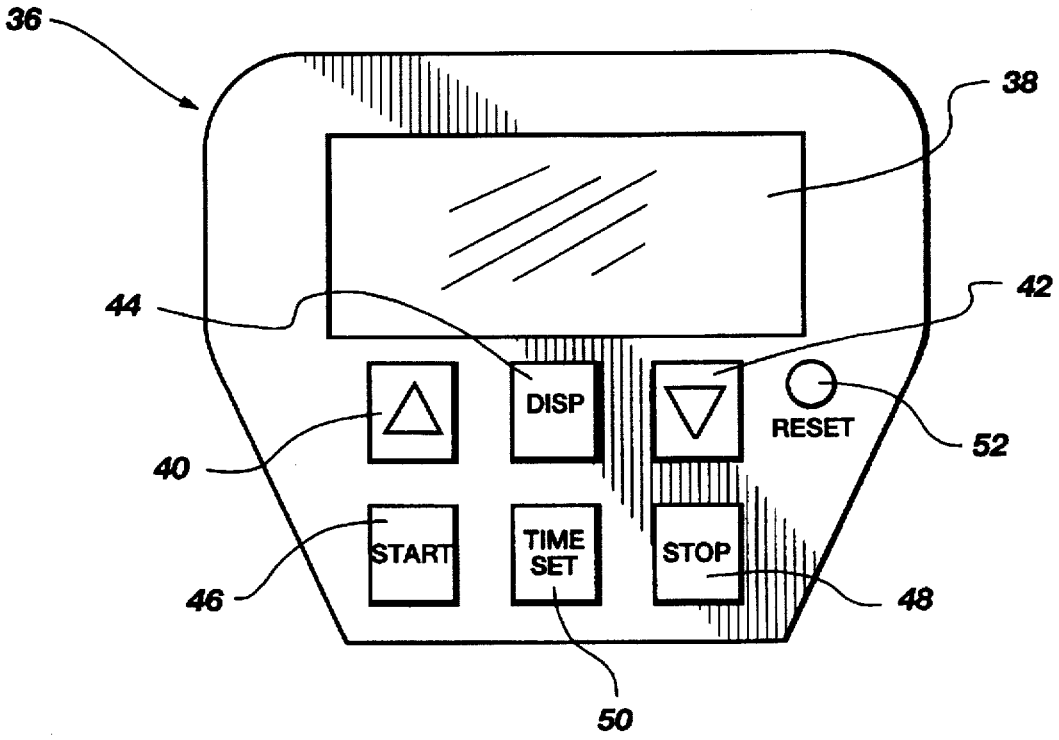
FIG. 4 is an exploded perspective view illustrating one presently preferred embodiment of the programmable timer unit of one presently preferred embodiment of the biomechanical stabilizer apparatus for strengthening unstable joints and improving muscle coordination.

Referring now to FIGS. 2 and 4, a timer unit 36 is preferably coupled to first end 28 of handle member 26 by a fastener. Preferably, timer unit 36 is removably coupled to handle member 26 by conventional fasteners without penetrating the interior of internal chamber 31, such as, for example, snap-fit connections, interlocking means, hook and loop fasteners, etc. Alternatively, timer unit 36 may be permanently coupled to first end 28 of handle member 26 by an adhesive or some other conventional fixation means. It will be readily appreciated, however, that timer unit 36 is contemplated as an optional feature of biomechanical stabilizer apparatus 10 and may or may not be physically attached thereto.

In one presently preferred embodiment of the present invention, timer unit 36 includes a microprocessor (not shown) and a display 38 for visually displaying the programming features of timer unit 36. In current design, display 38 preferably comprises a liquid crystal display. Timer unit 36 further comprises an audio feedback means which, in association with display 38, provides audio and visual feedback to the user of the present invention when the programming parameters of the biomechanical stabilizer apparatus 10 are satisfied.

As shown in FIG. 4, a plurality of input keys 40–52 are operably disposed on the front facing of timer unit 36. In current design, input keys 40–52 comprise pressure sensitive dome keys which are preferably actuated when depressed. It will be readily appreciated, however, that other suitable input means for entering programming parameters such as, for example, dial adjustment knobs, slide switches, touch sensitive switches, momentary or non-momentary switches, etc. are possible.

In one presently preferred embodiment of the present invention, input keys 40–52 are generally used as means for interactively programming timer unit 36. Input keys 40–52 assist in establishing the operational parameters of biomechanical stabilizer apparatus 10 for use in conducting therapeutic and/or rehabilitative exercise and exercise routines. To assist in the initialization of programming routines of timer unit 36, an input key 40 is provided for entering an increase in a particular value. Similarly, an input key 42 is provided for entering a decrease in a particular value.

As best illustrated in FIG. 4, a DISP key is provided for selecting and/or reviewing entered data programmed into timer unit 36, such as, for example, time durations, types of exercises (e.g., orbital or linear oscillatory movement), number of repetitions, approximate range of exercising angle(s), etc. A TIME SET key 50 is provided to facilitate means for entering a time allowance for completion of a designed exercise routine. TIME SET key 50, in coordination with value input keys 40, 42, provide a conventional programmable stopwatch timer device which counts down to 00:00:00 at which time an audio and/or visual output can be generated to alert the user that the programmed time has expired.

After the operating parameters of biomechanical stabilizer apparatus 10 have been programmed into timer unit 36 for a particular individual user, the present invention can be used for therapeutic and/or rehabilitative exercise by the identified user. In operation, a user of the present invention will preferably depress a START key 46 in order to initiate the programming parameters of the biomechanical stabilizer apparatus 10. A STOP key 48 may be provided to facilitate an interruption in any of the programming features of timer unit 36, if necessary. Moreover, STOP key 48 can be used to initiate a "pause" in the countdown of the durational time allowance programmed into timer unit 36.

If an attending physician, physical therapist or other health care provider is so inclined to modify any of the selected values of an exercise routine tailored for a particular individual user or group of users which has been programmed into timer unit 36, a RESET key 52 is provided to restart or clear any identified programming routines. Accordingly, RESET key 52, in combination with input keys 40 and 42, can be used to modify any of the programming parameters of timer unit 36. Based on the programming capability of timer unit 36, any individual user of the biomechanical stabilizer apparatus 10 does not need to visit a medical clinic, doctor's office or a physical therapy facility to conduct the orbital and linear oscillatory exercises facilitated by the present invention for strengthening unstable joints and/or improving muscle coordination, but rather the user can conduct the exercises in the privacy of their own home.

In an alternate preferred embodiment of the present invention, timer unit 36 may be replaced with a conventional stopwatch timer device which is limited to providing only durational time programming. In another alternate preferred embodiment of the present invention, the operational parameters of an exercise routine may be programmed by a computer and transferred to timer unit 36 through conventional data communication protocol, such as, for example, RS-232 serial communication, parallel communication, infra-red data communication, etc. Similarly, performance data such as, for example, the number of repetitions, frequency of exercise(s), and intensity of the programmed orbital and/or linear oscillatory exercises, may be readily monitored by means of positioning a pressure sensor along the surface of internal channel 24 of circular member 22 and/or internal chamber 31 of handle member 26. Accordingly, the performance data gathered can be stored by timer unit 36 for later retrieval and evaluation by a physician, physical therapist or other health care provider in order to subsequently monitor a user's therapeutic and/or rehabilitative progress. It will be readily appreciated by those skilled in the art that other possible combinations of input keys and/or variations of conventional timer unit capabilities are possible which are consistent with the spirit and scope of the present invention.

In operation, the method of one presently preferred embodiment of the present invention provides a user diagnosed, for example, with upper back, shoulder and/or joint instability, with a novel exercise device which aids in restoring stability to the shoulder, back and upper joints, while significantly improving muscle coordination. In design, the network of muscles which acts upon the shoulder complex is essential for the shoulder's joint articulations to function synchronously and efficiently.

Anatomically, the shoulder represents the first link in a mechanical chain of levers that extend from the shoulder to the fingertips and further assist in the movement of the shoulder through nearly a full arc in both the frontal and sagittal planes. This freedom of movement is possible in part due to the anatomical configuration of the glenohumeral joint found between the humerus and the scapula. The glenohumeral joint comprises a minimally constrained ball-and-socket configuration which allows for greater freedom of movement than a more rigid ball-socket joint such as the hip, thus contributing significantly to the large range of motion of the shoulder as a whole. While the anatomic configuration of the glenohumeral joint allows for significant motion, it makes the joint more susceptible to anterior, posterior, inferior and/or superior instability. Accordingly, dislocation and recurrent subluxation of the glenohumeral joint are common.

In practice, to provide therapeutic and/or rehabilitative exercise to the shoulder complex, a user of the present invention may begin by gently rocking circular member 22 in a back and forth motion in order to initiate the rotation of free moving bodies 34*a* disposed within internal channel 24. As free moving bodies 34*a* begin to oscillate back and forth, the hand gripping handle member 26 begins to make orbital movements. To maintain the stability of the shoulder, it is important to coordinate the orbital hand movements of circular member 22 with the motion and direction of free moving bodies 34*a*.

By rotating free moving bodies 34*a* within the annular cross-sectional area of internal channel 24 thereby encouraging travel around the perimeter of circular member 22, biomechanical stabilizer apparatus 10 provides orbital exercise movements which impact the user's shoulder muscles, back and upper joints, thus facilitating meaningful therapeutic and/or rehabilitative exercise to an affected muscle, muscle group and/or joint(s) while enhancing the user's range of motion and improving muscle coordination. For example, orbital oscillation exercise movements can be conducted in multiple positions in any given plane (e.g., a first range of between approximately 35° and 70° ) and either in front or at the side of the user. The various positions, duration of exercise and frequency, however, will be generally circumscribed according to both clinical diagnosis and patient endurance.

Alternatively, biomechanical stabilizer apparatus 10 further provides means for strengthening unstable joints and improving muscle coordination by facilitating linear oscillation exercise movements to provide meaningful therapeutic and/or rehabilitative exercise to the shoulder, upper back and joints while affecting muscle, muscle group and/or joint(s) in a different therapeutic manner than the exercise advantages of the orbital oscillation of free moving bodies 34*a* in circular member 22. In this regard, linear movement performed by oscillating free moving body 34*b* within internal chamber 31 of handle member 26 through multiple ranges in a cardinal plane can significantly strengthen agonist-antagonist muscle groups. For example, by linearly oscillating free moving body 34*b* back and forth within internal chamber 31 at a first position of approximately 15°, at a second position of approximately 45° and at a third position of approximately 75°, biomechanical stabilizer apparatus 10 will provide feedback for these directional changes and, if performed rapidly, the quick changes in direction may provide a plyometric-like effect on the muscle or muscle group.

The primary function of free moving bodies 34*a*, 34*b* is to provide a form of feedback to the user. Although an increase in rotational speed of free moving bodies 34*a*, 34*b* may provide slightly more resistance, the hand motion required for the orbital and linear oscillation of free moving bodies 34*a*, 34*b* is the key to providing meaningful therapeutic and/or rehabilitative exercise using the present invention. In one presently preferred application of the present invention, the mobility of the distal hand influences the development of stability in the proximal shoulder, chest and back muscles. Accordingly, the orbital and linear exercise movements facilitated by use of biomechanical stabilizer apparatus 10 is instituted by sequential muscle firing and thus subsequently demands the development of a high degree of muscle coordination. Moreover, the therapeutic and/or rehabilitative exercises provided by the present invention may further facilitate neuromuscular proprioceptor stabilization of the shoulder (e.g., shoulder complex) and the muscles therearound.

Figure 5:
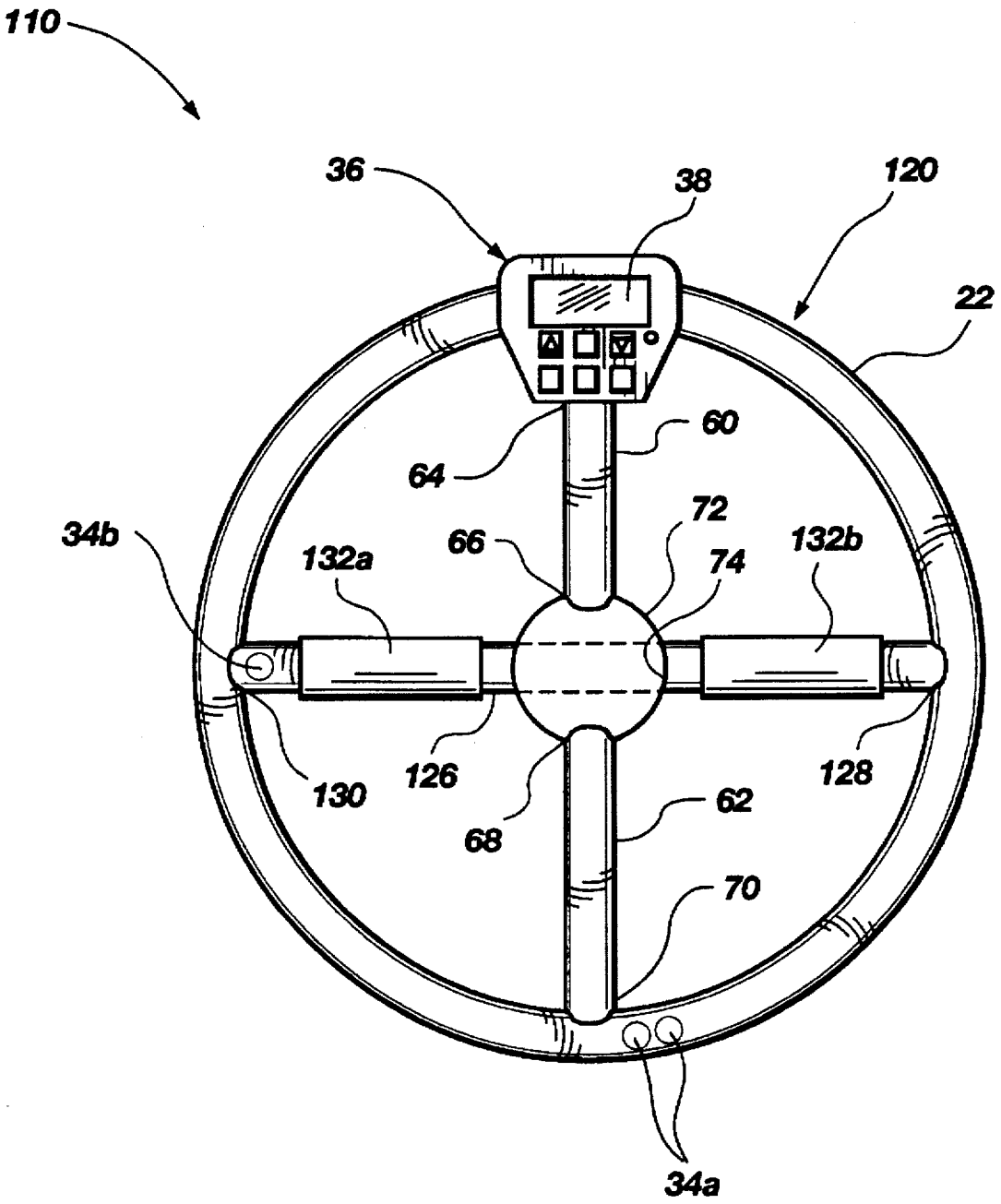
FIG. 5 is a perspective view of one presently preferred embodiment of a support assembly of an alternate presently preferred embodiment of the biomechanical stabilizer apparatus for strengthening unstable joints and improving muscle coordination.

In another presently preferred application of the present invention, an alternate preferred embodiment of biomechanical stabilizer apparatus 110 is illustrated as including tubing assembly 120 incorporating circular member 22 and handle member 126, and further comprising support members 60, 62 operably engaging an engagement member 72 for supporting the structural integrity of circular member 22, as best shown in FIG. 5. As shown, handle member 126 preferably extends substantially transverse dimensionally across the internal diameter of circular member 22 and is operably connected thereto at opposing ends 128, 130. Circular member 22 is formed having an internal channel 24 comprising at least one free moving body 34*a* rotatably disposed therein. Similarly, handle member 126 is formed having an internal chamber 31 wherein at least one free moving body 34*b* is disposed.

In current design, handle member 126 is preferably formed comprising an elongated body having an annular cross-section providing an outer periphery sufficient to facilitate gripping means 132*a*, 132*b*. Gripping means 132*a*, 132*b* are preferably coupled to handle member 126 on the opposing sides of engagement member 72. In accordance with the foregoing preferred arrangement, gripping means 132*a*, 132*b* provide means for the user of biomechanical stabilizer apparatus 110 to grip handle member 126 with both hands when conducting orbital or linear oscillatory exercises, as discussed above. In operation, gripping both gripping means 132*a*, 132*b* when performing therapeutic and/or rehabilitative exercise provides means for facilitating back and torso stabilization.

Engagement member 72 is substantially spherical in configuration and comprises an opening 74 preferably formed within opposing sides of engagement member 72. Preferably, opening 74 is formed having a size and shape being substantially complimentary to the outer periphery of handle member 126. Accordingly, handle member 126 may be introduced through opening 74 of engagement member 72 and passed through the internal cavity of engagement member 72 and out the opposite opening 74. It will be readily appreciated, however, that other shapes, sizes or configurations of engagement member 72 are possible which are consistent with the spirit and scope of the present invention.

In current design, engagement member 72 is preferably formed of a substantially rigid, non-resilient material such as, for example, any of numerous organic, synthetic or processed materials that are mostly thermoplastic or thermosetting polymers of high molecular weight, with or without additives, such as plasticizers, autooxidants, colorants, or fillers, which can be shaped, molded, cast, extruded, drawn, foamed or laminated into objects, films or filaments, fiberglass, wood, metal, ceramic, glass, an acrylic resin or any other suitable material which provides sufficient rigidness.

Operably engaging engagement member 72 on opposing sides thereof is a first support member 60 and a second support member 62. Preferably, support members 60, 62, respectively, engage engagement member 72 at approximately 90° from handle member 126. Support members 60, 62 are preferably cylindrical in shape and formed of a rigid material having sufficient sturdiness to provide structural integrity to circular member 22. It will be readily appreciated by those skilled in the art that other positions, shapes or configurations of support members 60, 62 are possible.

In one presently preferred embodiment of biomechanical stabilizer apparatus 110, support members 60, 62 comprise a first end 64, 70 and a second end 66, 68, respectively. First end 64, 70 of support members 60, 62 are preferably formed having a complimentary contoured shape being generally semi-circular in configuration so as to extend around between approximately 15% and 50% of the outer periphery of the annular cross-section of circular member 22 in connection therewith. Second end 66, 68 are preferably formed having a contoured shape substantially corresponding to the configuration of engagement member 72 so as to extend around between approximately 15% and 50% of the outer periphery of engagement member 72 in connection therewith. Those skilled in the art will readily recognize other possible modifications and adaptation which are consistent with the spirit and scope of the present invention for forming a connection between support members 60, 62 at their respective ends in relation to circular member 22 and engagement member 72.

In current design, the opposing ends of first support member 60 and second support member 62 are rigidly secured to circular member 22 and engagement member 72 by means of an adhesive, such as, for example, an epoxy, polyurethane resins, butyl tape, polysulfide elastomers, elastomeric styrene-butadiene copolymers, polycarbonate polymers, mucilaginous substances or the like. Alternatively, other conventional fasteners, securing means or compatible fastening components may be used which are consistent with the spirit and scope of the present invention.

Preferably engaging support member 60 at first end 64 is programmable timer unit 36 for programming time durations and providing means for visual and/or audio feedback to the user when the programming parameters of the present invention are satisfied. As will be readily recognized by those skilled in the art, programmable timer unit 36 may engage for example, support member 62 at first end 70, or any other suitable position on biomechanical stabilizer apparatus 10, 110 as convenience would necessitate.

In an alternate presently preferred embodiment of the present invention for facilitating orbital and/or linear oscillatory exercise to the back and torso region of the body, support members 60, 62 may directly engage handle member 126 without having to engage engagement member 72 therebetween.

As generally explained above, the present invention of biomechanical stabilizer apparatus 10 is primarily designed for use by patients diagnosed with shoulder, upper back and/or joint instability. As will be readily appreciated by those skilled in the art, similar configurations of the present invention may be used for therapeutic and/or rehabilitative exercise for muscle, muscle groups and/or joint(s) of the wrist, waist, hip, legs, etc. For the exercises to be safe and effective, however, careful instruction and demonstration are essential.

From the above discussion, it will be appreciated that the present invention provides a biomechanical stabilizer apparatus and methods which facilitate therapeutic and/or rehabilitative exercise for strengthening unstable joints and improving muscle coordination and which can be conducted at home, whereby reducing the number of expensive therapy visits to a doctor's office or physical therapy facility. The present invention further provides a biomechanical stabilizer apparatus for strengthening unstable joints and improving muscle coordination which is capable of providing both orbital and linear oscillatory exercise to provide means for increasing the therapeutic and/or rehabilitative efficiency of the user's exercise output by inducing increased muscular contraction and relaxation.

Unlike prior art exercise devices, the present invention provides a biomechanical stabilizer apparatus and methods for strengthening unstable joints and improving muscle coordination which includes an interactive, programmable timer unit for inputting and monitoring the durational lapse of time and for providing means of visual and/or audio feedback to the user conducting therapeutic and/or rehabilitative exercises. In addition, the present invention provides a biomechanical stabilizer apparatus and methods for strengthening unstable joints and improving muscle coordination which comprises a plurality of free moving bodies disposed within a tubing assembly which are therapeutically important to help establish an oscillatory frequency needed to initiate and maintain these bodies in rotational motion. Moreover, the present invention provides a biomechanical stabilizer apparatus and methods which is interesting to use, stimulates the cardiovascular system and is capable of providing different levels of exercise resistance.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A biomechanical stabilizer apparatus for strengthening unstable joints and improving muscle coordination, comprising:

a substantially circular member including an outer periphery and an internal channel, said internal channel having an internal diameter slightly smaller than said outer periphery of said circular member;

a handle member operably connected to said circular member, said handle member comprising an outer periphery having a diameter sufficient to facilitate gripping, said handle member including an internal chamber, said internal chamber having an internal diameter slightly smaller than said outer periphery of said handle member;

at least two free moving bodies disposed within said internal channel of said circular member, said free moving bodies having a diameter less than said internal diameter of the internal channel and adapted to move within said internal channel without obstruction; and at least one free moving body disposed within said internal chamber of said handle member, said free moving body having a diameter less than said internal diameter of the internal chamber and adapted to move within said internal chamber without obstruction.

2. A biomechanical stabilizer apparatus as defined in claim 1 further comprising a timer unit engaging said circular member.

3. A biomechanical stabilizer apparatus as defined in claim 2 wherein said timer unit is programmable.

4. A biomechanical stabilizer apparatus as defined in claim 2 wherein said timer unit may be operably attached to said handle member.

5. A biomechanical stabilizer apparatus as defined in claim 1 further comprising a support assembly for structurally supporting said circular member, said support assembly engaging said circular member perpendicular to said handle member.

6. A biomechanical stabilizer apparatus as defined in claim 1 wherein said outer periphery of said circular member comprises a diameter sufficient to facilitate gripping.

7. A biomechanical stabilizer apparatus as defined in claim 1 wherein said internal channel of said circular member is uniformly sealed.

8. A biomechanical stabilizer apparatus as defined in claim 1 wherein said circular member is formed of a substantially transparent material.

9. A biomechanical stabilizer apparatus as defined in claim 1 wherein said handle member is substantially elongated.

10. A biomechanical stabilizer apparatus as defined in claim 1 wherein said handle member extends substantially transverse said circular member.

11. A biomechanical stabilizer apparatus as defined in claim 1 wherein said handle member is formed of a substantially transparent material.

12. A biomechanical stabilizer apparatus as defined in claim 1 wherein said internal chamber of said handle member is uniformly sealed.

13. A biomechanical stabilizer apparatus as defined in claim 1 wherein said outer periphery of said handle member comprises a resilient material.

14. A biomechanical stabilizer apparatus as defined in claim 1 wherein said free moving body disposed within said internal channel of said circular member is substantially spherical in shape.

15. A biomechanical stabilizer apparatus as defined in claim 1 wherein said free moving body disposed within said internal chamber of said handle member is substantially spherical in shape.

16. A biomechanical stabilizer apparatus for strengthening unstable joints and improving muscle coordination, comprising:

a substantially circular member including an outer periphery having a diameter to facilitate gripping and a sealed internal channel, said internal channel having an internal diameter slightly smaller than said outer periphery of the circular member;

a handle member extending transverse said circular member and operably connected thereto, said handle member comprising an outer periphery having a diameter sufficient to facilitate gripping, said handle member further including a sealed internal chamber, said internal chamber having an internal diameter slightly smaller than said outer periphery of said handle member;

at least two free moving bodies disposed within said internal channel of said circular member, said free moving bodies having a diameter less than said internal diameter of the internal channel of the circular member and adapted to freely move within said internal channel without obstruction;

at least one free moving body disposed within said internal chamber of said handle member, said free moving body having a diameter less than said internal diameter of the internal chamber of the handle member and adapted to freely move within said internal chamber without obstruction; and a timer disposed in relation to said circular member.

17. A biomechanical stabilizer apparatus as defined in claim 16 further comprising a support assembly for structurally supporting said circular member, said support assembly engaging said circular member perpendicular to said handle member.

18. A biomechanical stabilizer apparatus as defined in claim 17 wherein said support assembly comprises a first support member, a second support member and an engagement member formed therebetween.

19. A biomechanical stabilizer apparatus as defined in claim 16 wherein said timer is programmable.

20. A biomechanical stabilizer apparatus as defined in claim 16 wherein said timer may be operably coupled to said handle member.

21. A biomechanical stabilizer apparatus as defined in claim 16 wherein said circular member is formed of a substantially transparent material.

22. A biomechanical stabilizer apparatus as defined in claim 16 wherein said handle member is formed of a substantially transparent material.

23. A biomechanical stabilizer apparatus as defined in claim 16 wherein said free moving body disposed within said internal channel of said circular member is substantially spherical in shape.

24. A biomechanical stabilizer apparatus as defined in claim 16 wherein said free moving body disposed within said internal chamber of said handle member is substantially spherical in shape.

25. A biomechanical stabilizer apparatus as defined in claim 16 wherein said outer periphery of said handle member comprises a resilient material.

* * * * *